United States Patent [19]

Smith

[11] 3,933,162

[45] Jan. 20, 1976

[54] COIN FEEDING DEVICES

[75] Inventor: Colin Howard Stanwell Smith, Cambridge, England

[73] Assignee: Automatic Revenue Controls (Europa) Ltd., Watford, England

[22] Filed: Sept. 3, 1974

[21] Appl. No.: 502,525

Related U.S. Application Data

[63] Continuation-in-part of Ser. No. 467,875, May 8, 1974, abandoned.

[30] Foreign Application Priority Data

May 16, 1974 France ..... 74.17128
May 17, 1973 United Kingdom ..... 23663/73

[52] U.S. Cl. ..... 133/1 R; 133/3 H
[51] Int. Cl.[2] ..... G07D 3/00
[58] Field of Search ..... 133/1 R, 4, 3 E, 3 H, 8 A; 221/170, 163, 156, 167, 168, 169; 198/33 R, 33 AC

[56] References Cited

UNITED STATES PATENTS

| | | | |
|---|---|---|---|
| 2,532,760 | 12/1950 | Davies | 221/167 |
| 2,853,176 | 9/1958 | Kay et al. | 221/167 X |
| 3,568,882 | 3/1971 | Aidlin | 221/167 |

*Primary Examiner*—Allen N. Knowles
*Attorney, Agent, or Firm*—Wood, Herron & Evans

[57] ABSTRACT

Apparatus for feeding coins one at a time into a coin-operated device, comprising a disc mounted for rotation about an axis tilted from the horizontal, an entry guide arranged to drop the coins onto the disc, and pairs of protruding pins on the disc which are arranged to engage the coins and carry them around the disc to an exit chute. Elongate brush-like guide members facing the disc are provided to insure that the coins are guided in the desired path and do not become superimposed on one another but are fed individually to the exit.

25 Claims, 6 Drawing Figures

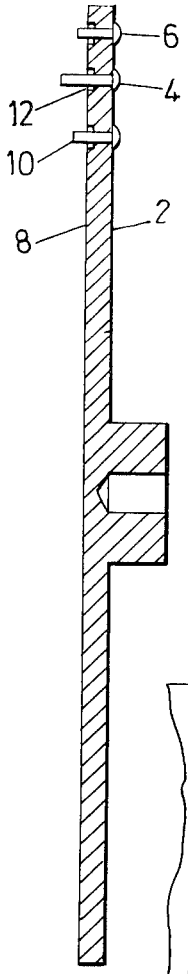
FIG.1.
FIG. 2.
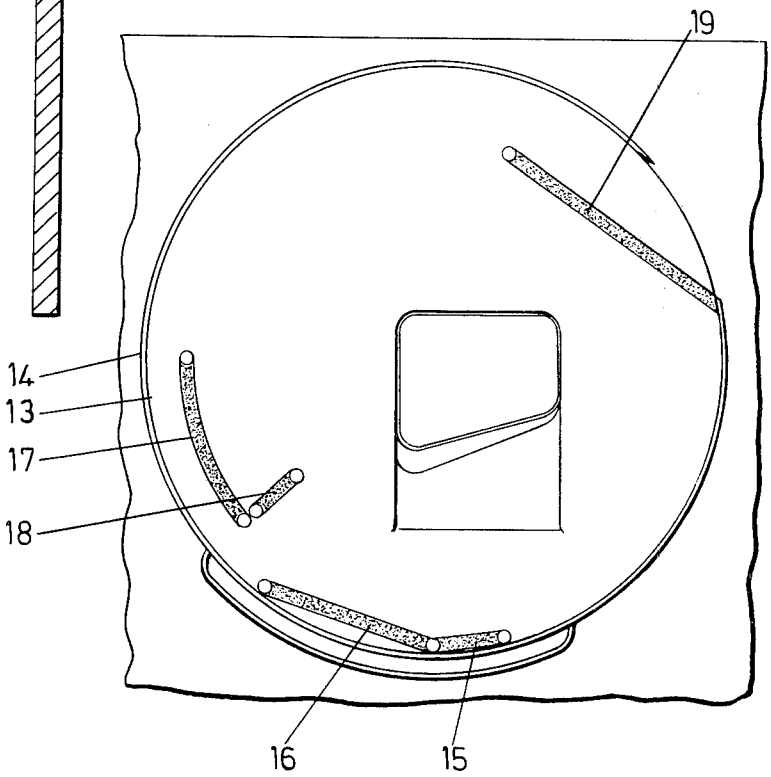

COIN FEEDING DEVICES

This application is a continuation-in-part of U.S. application Ser. No. 467,875, filed May 8, 1974, now abandoned.

This invention relates to coin feeding devices, and particularly to apparatus which is designed to present coins, one at a time, in a predetermined attitude, to a coin recognition device in a vending machine, for example.

Apparatus according to the invention for feeding coins in a coin-operated device, comprises a disc which is mounted for rotation about an axis which is tilted slightly from the horizontal, and is provided with at least one pair of pins projecting outwardly from its surface which are arranged and positioned so that when a plurality of coins are fed to the disc while it is rotating, each coin in turn is carried around by the pins to an exit chute.

Preferably, the two pins of each pair are spaced apart radially on the disc, the distance between them being slightly less than the diameter of the smallest coin which is to be handled. In a preferred arrangement, in which the disc is rotated by means of a motor at about one revolution per second, and the coins are to be fed from the disc at 120 millisecond intervals, eight pairs of pins are provided, spaced apart at 45° intervals around the disc. A greater or smaller number of pairs of pins may be provided but in any case the disc must be large enough to allow adjacent pairs of pins to be spaced apart by a distance somewhat greater than two diameters of the largest coin to be handled, in order to avoid such coins becoming jammed between adjacent pairs of pins. This situation can arise when the distance is slightly less than two diameters, because two such coins may then "bridge" the gap between adjacent pairs of pins, becoming wedged at a slight angle to the surface of the disc.

The pin pairs are preferably arranged near the circumference of the disc so that coins can be fed on its surface in the region between the center and the pin pairs, and one or more additional pins may be provided in this area, so that it is swept at least once every revolution and coins are prevented from becoming jammed at the input.

In a preferred embodiment of the invention, one pin of each pair protrudes outwardly from the surface of the disc by a distance equal to the thickness of the thinnest coin to be handled, so that only one coin can be driven by each pair, at a time, while the other pin protrudes somewhat further so as to improve the "pick-up" efficiency. The outer pin of each pair may be the shorter. In one preferred embodiment one of the eight pair has the outer pin longer and the inner shorter, the remainder of the pairs having the outer pin shorter.

In order to present the coins in the required orientation to the pick-up pins, brush-like members are preferably provided at suitable positions extending towards the disc, so that the coins are maneuvered into the desired position against the pins by the rotation of the disc.

In order to retain the coins against the surface of the disc, the apparatus is preferably provided with a further arcuately extending retaining device which may also comprise a plurality of resilient members such as fibres forming a brush which extends towards the face of the disc. In one embodiment of the invention, a number of other similar retaining and guiding brushes may be provided at different points along the path of travel. A similar brush "wall" extends around the outer periphery of the disc, so that the disc just skims the fibres of the brush as it rotates. Alternatively a solid plastics wall may be provided around the periphery of the disc. As each pair of pins reaches top dead center, the coin becomes unstable and flies off in a path generally tangential to its previous path. At this point, a further brush may be provided to assist in guiding the coin in the required direction.

The disc is preferably mounted on a hinged plate, so that it can swing backwards if an abnormally heavy object should be thrown into it, and the plate is preferably normally held in position by a magnetic burst latch, so that it remains open until the mechanism is reset.

In a further embodiment which is not shown the hinge and magnetic burst latch arrangement is not used but is replaced on fixed but sprung location means and a clutch between the motor and disc to prevent damage to the pins on the disc. A further development of this arrangement is a self-clearing reversing and restarting cycling program in which if the disc jams, the polarity of the motor is reversed for half a revolution and then reversed to attempt to obtain normal rotation. The clutch assists in removing inertial stress between the motor and disc.

Two embodiments of the invention will now be described by way of example with reference to the accompanying drawings in which:

FIG. 1 is a diametral cross-section taken through the disc of a first embodiment;

FIG. 2 is a rear elevation of a brush holder for the disc of FIG. 1;

Figure 5:
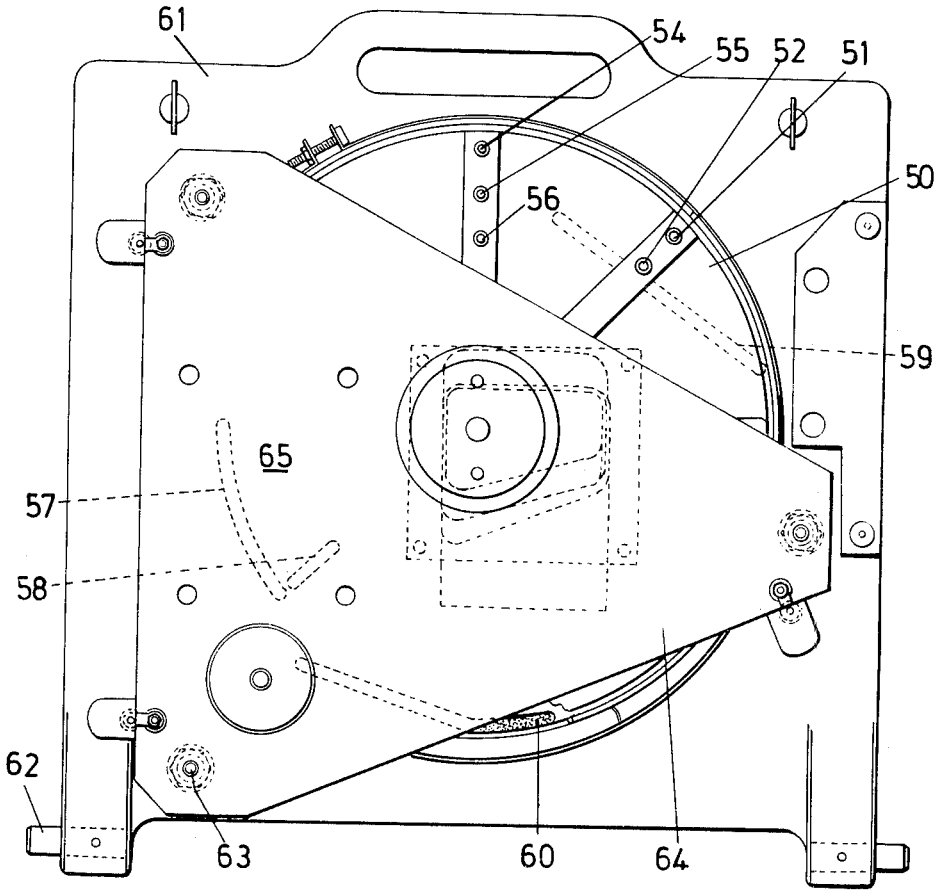
Figure 6:
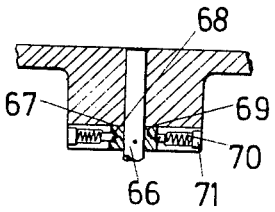

FIG. 5 is a rear elevation of a mechanism according to a second embodiment; and FIG. 6 is a cross section of a clutch taken along D—D of Figure Referring to FIG. 1, in this embodiment the disc is 254 millimeters in diameter and carries eight pairs of radially-spaced apart pins. One pin of each pair is situated at a radius of 100 millimeters while the other is situated at a radius of 119 millimeters, so that the distance between centers of the pins is 19 millimeters, and since the pins are of 3 millimeter diameter stainless steel, the space between the two pins of each pair is 16 millimeters. This allows the pair of pins to "drive" the smallest coin which the mechanism may be called upon to deal with (a British half-penny apiece of 17.2 millimeters diameter). The outer pin 6 of each pair projects a distance of 1.5 millimeters from the other face 8 of the disc, while the inner pin 4 projects by a distance of 5.5 millimeters. A separate, single pin acting as a clearing pin which protrudes by a distance of 3 millimeters, is situated at a distance of 81 millimeters from the center of the disc, so as to sweep the coin input area once in every revolution. A counterbore 6 millimeters in diameter and 1 millimeter deep is provided at the position of each pin, so as to form a recess surrounding the pin, to prevent dust or other matter from building up around the base of the pin.

The pins may alternatively be in the form of small bolts or screws screwed into the disc from the back and having their ends turned down to form plain posts or the pins may be formed as projections which may be formed by moulding or casting standing out from the disc surface.

The brushes which skim the surface of the disc in use, are supported by a rectangular casting which has a central boss 13 around which a plastics retaining wall 14 is located.

On entering the apparatus, a coin drops until it engages a first short section of brush located at 15 on the boss 13 which positions it so that at least one of the pins engages against it. A longer section of brush 16 then pushes it towards the center of the two pins of the pair.

A curved section 17 of brush, which runs parallel to the side retaining wall and extends over the center line of the pins, acts to separate a pair of coins if they are superimposed, and a short radially-extending brush 18 acts to dislodge any coins which become lodged above one or more others already engaged by the pins. This may happen for example in a case where three coins travel around together in a "triangular" array.

A further groove 19 which is straight, and is arranged to be approximately tangential to the circular path of the coins, as they leave the disc at the top dead center position, holds a brush which guides the coins away from the disc. One of the advantages of using brushes is that the pins can press freely through them where necessary and they are not damaged by foreign objects.

Figure 3:
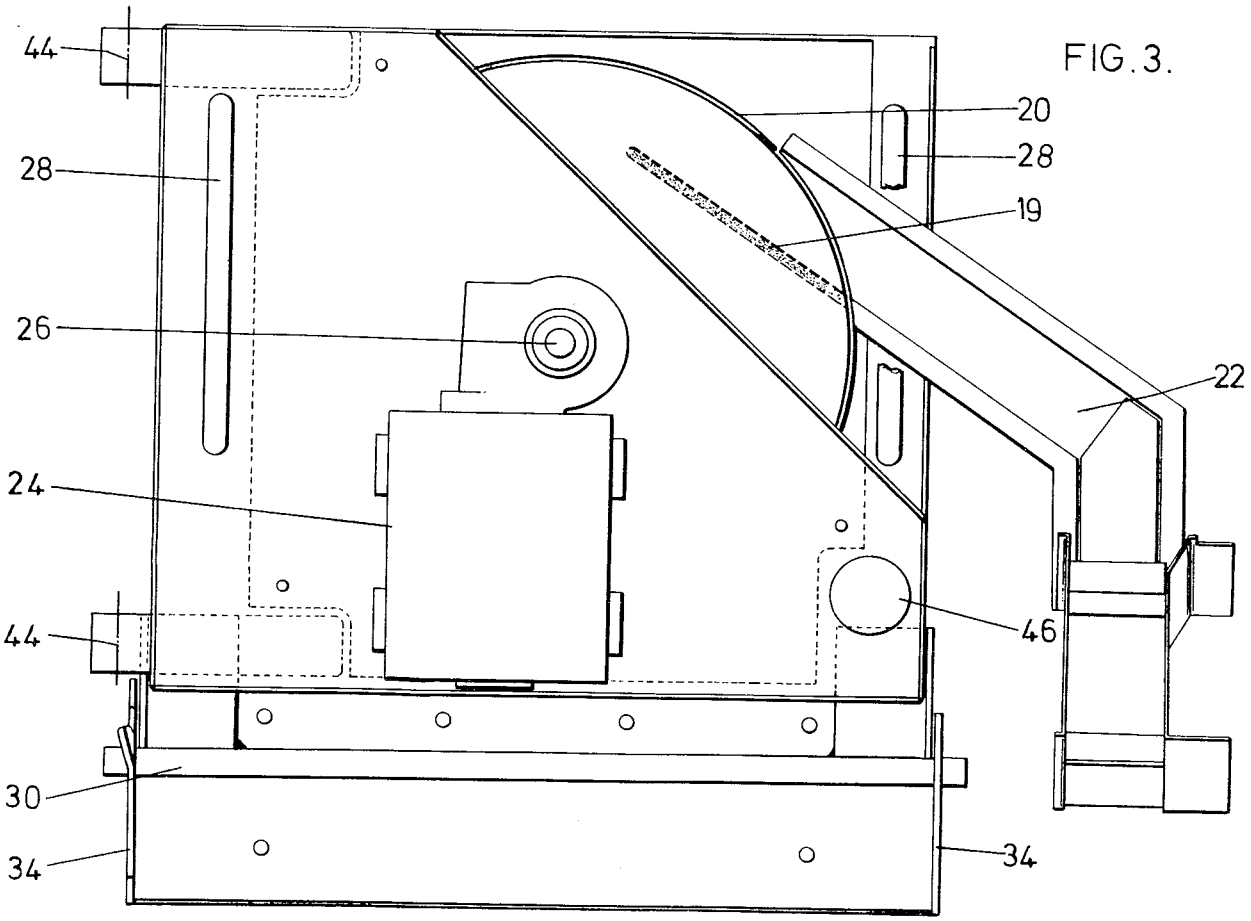
FIG. 3 is a rear elevation of the assembled mechanism of FIG. 2.

FIG. 3 shows a diagrammatic rear view of the cabinet of the coin feeder, showing the positions of the parts of the mechanism when installed, and the position of the disc is shown by the circle 20. The position of the exit brush groove 19 in alignment with a chute 22 which guides the coins away from the disc, is also indicated to the right of the drawing. A motor 24 is mounted at the rear of the mechanism and drives a shaft 26 upon which the disc is mounted, (FIG. 4) and a pair of handles 28 are also provided, one at each side of the cabinet to facilitate removal of the mechanism for servicing. The mechanism is provided with a horizontal bar 30 near its base, the ends of which engage in slots 32 in the side plates 34 of the mounting, and a latch 36 is provided at the top of the mechanism, which engages behind a bar 38 in its normal position. By releasing the latch 36, the mechanism can be lifted out using the handles 28.

The backplate 40 of the mechanism, upon which the motor and the disc are mounted, is hinged about a vertical axis 44 at one side, the other side being held in engagement with the plate 42 by means of a magnetic catch 46. Thus, if an object should be thrown into the mechanism with great force, the backplate 40 can swing away from the cabinet.

Figure 4:
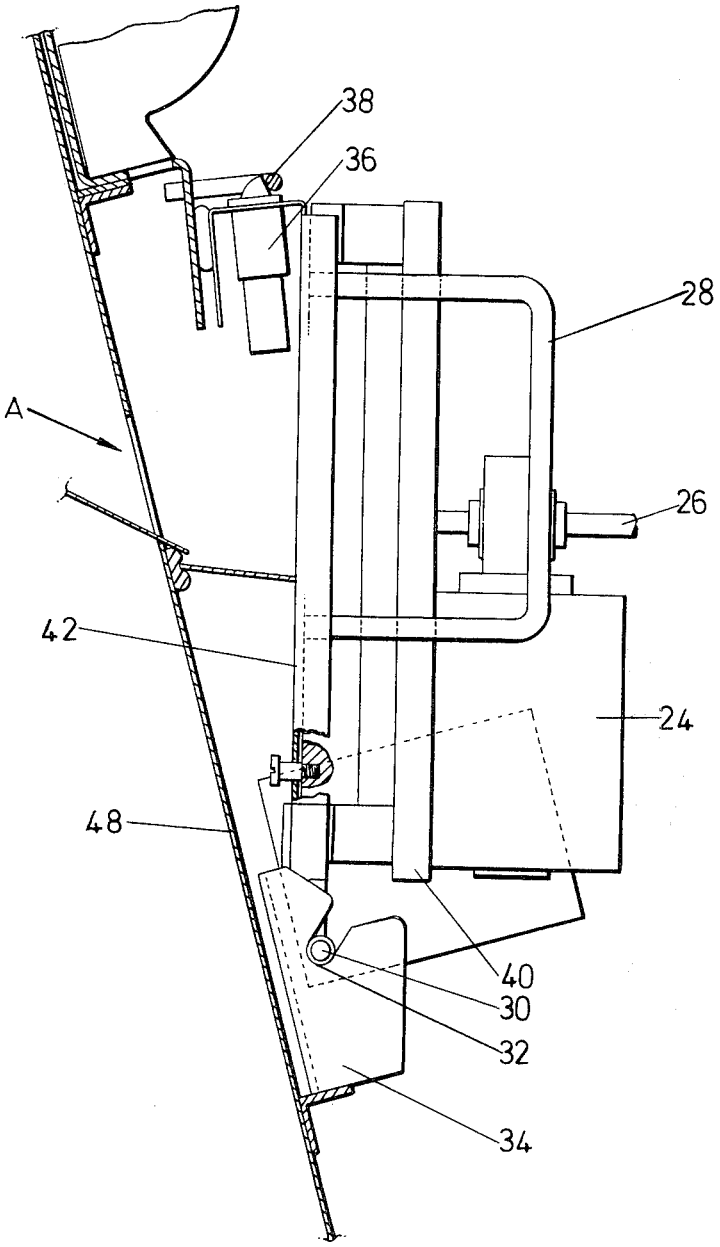
FIG. 4 is a side elevation of the mechanism of FIG. 3.

Although FIG. 4 shows the mechanism of the coin feeder in a vertical plane, and the front of the cabinet 48 tilted from the vertical, it will be appreciated that in use, the front of the cabinet 48 is in fact vertical, and the mechanism is tilted back at a corresponding angle to that shown in the drawing, so that coins entering the mechanism in the direction indicated generally by the arrows A, will fall against the disc and rest on it in the required attitude. It will be noted, however, that the disc is not tilted over so far from the vertical that coins will pile up on it.

FIG. 5 shows a second embodiment in which the disc 50 is provided with eight pairs of pins arranged in a similar way to the pins in the disc shown in FIG. 1. In the FIG. 5 disc in seven of the pairs the outer pins 51 project 1.0 millimeter and the inner pins 52 project 5.5 millimeters but the eighth pair has the dimensions reversed so that outer pin 54 projects 5.5 millimeters and inner pin 55 projects 1.0 millimeters. Also there are four clearing pins 56 spaced at 90° at the pin pair positions.

The clearing pins 56 act so as to pick up a coin from a misaligned position resting against a brush 58 or some other misaligned position. The coin picked up by one of the clearing pins 56 is thrown onto one of the pairs of pins 51, 52 or 54, 55 to complete its normal cycle onto the exit brush 59 and thence down a chute (not shown in FIG. 5 but equivalent to chute 22).

In FIG. 5 can also be seen deflecting brushes 57 and 60 which are mounted with 59 and 58 on a main base plate 61. This base plate 61 is hinged on pivot pins and can be lifted out of the vending machine for repair or renewal. Also mounted on the base plate by means of three sprung spigots 63 is a sub base plate 64 on which is mounted in position 65 a motor (not shown). The motor drives via a worm and wormwheel through a latch shown in FIG. 6 onto the disc 50.

In FIG. 6 can be seen details of the clutch on the disc drive shaft 66. The shaft 66 is fixedly pinned to an annular member 67 in which are two holes 68. The holes receive in a clutched in condition two pins 69 urged inwards by springs 70 acting against plugs 71.

In the event of a jam in the mechanism such that the motor could not rotate the disc, the pins 69 disengage from the holes 68 and the clutch slips. A further safety device is arranged in the electrical circuitry of the motor supply so that if the disc jams, the polarity of the motor field coils 13 reversed and the disc rotates half a revolution. The motors field coils is then reversed and the motor then tries again to rotate the disc in the normal direction. This action will continue until the disc clears itself.

It will be seen in FIG. 4 that the angle of tilt of the mechanism which includes the rotatable disc (shown in FIG. 1 but not visible in FIG. 4) is at 15° to the vertical. However, 20° to the vertical has been found to give a better performance. The angle of tilt of the disc from the vertical has been found in some cases to be critical and indications are that a variation of 2° from the optimum of 20° may be unacceptable.

I claim:

1. Apparatus for feeding coins in a coin operated device, comprising a rotatable disc, entry guide means arranged to guide a coin onto the surface of the disc, means mounting the disc for rotation about an axis which is tilted from the horizontal;

a motor drivingly connected to the disc;

at least one pair of coin-engaging pins projecting outwardly from the surface of the disc, the two pins of each pair being spaced apart radially on the disc a distance slightly less than the diameter of the smallest coin to be handled, an exit chute for the coin, whereby when a plurality of coins are fed into the guide means, each coin in turn is engaged by a set of pins and carried to the exit.

2. Apparatus according to claim 1 having eight pairs of pins, spaced apart at 45° intervals around the disc.

3. Apparatus according to claim 1 in which the pins are arranged near the circumference of the disc.

4. Apparatus according to claim 1 in which the guide means is positioned between the center of the disc and the pins.

5. Apparatus according to claim 1 in which the radially outer pin of each pair is short and protrudes outwardly from the surface of the disc by a distance equal to the thickness of the thinnest coin to be driven, while the other pin is longer.

6. Apparatus according to claim 1 further comprising at least one elongate brush-like guide member;

mounting means to hold the guide member in a position facing the disc and below the entry guide means so as to guide the coins, in use, against the pins.

7. Apparatus according to claim 1 further comprising an arcuate brush-like guide member, and mounting means to hold the guide member in a position facing the disc and parallel to the periphery of the disc, over the circular path of the coins.

8. Apparatus according to claim 1 further comprising an elongate brush-like member, and mounting means locating the brush-like member adjacent the exit chute, whereby the coin is guided to the exit chute on leaving the disc.

9. Apparatus for feeding coins in a coin operated device, comprising a rotatable disc, entry guide means arranged to guide a coin onto the surface of the disc, means mounting the disc for rotation about an axis which is tilted from the horizontal;

a motor drivingly connected to the disc;

a plurality of pairs of radially spaced apart pins arranged in a circular array and projecting outwardly from the surface of the disc; each pair of pins being separated by a distance of between two and three diameters of the largest coin to be handled;

and an exit chute for the coin, whereby when a plurality of coins are fed into the guide means, each coin in turn is engaged by a set of pins and carried to the exit.

10. Apparatus according to claim 9 in which the two pins of each pair are spaced apart radially on the disc, the distance between them being slightly less than the diameter of the smallest coin to be handled.

11. Apparatus according to claim 9 having eight pairs of pins, spaced apart at 45° intervals around the disc.

12. Apparatus according to claim 9 in which the pins are arranged near the circumference of the disc.

13. Apparatus according to claim 9 in which the guide means is positioned between the center of the disc and the pins.

14. Apparatus according to claim 9 in which the radially outer pin of each pair is short and protrudes outwardly from the surface of the disc by a distance equal to the thickness of the thinnest coin to be driven, while the other pin is longer.

15. Apparatus according to claim 9 further comprising at least one elongate brush-like guide member;

mounting means to hold the guide member in a position facing the disc and below the entry guide means so as to guide the coins, in use, against the pins.

16. Apparatus according to claim 9 further comprising, an arcuate brush-like guide member, and mounting means to hold the guide member in a position facing the disc and parallel to the periphery of the disc, over the circular path of the coins.

17. Apparatus according to claim 9 further comprising an elongate brush-like member, and mounting means locating the brush-like member adjacent the exit chute, whereby the coin is guided to the exit chute on leaving the disc.

18. A device as claimed in claim 1 characterised in that the radially outer pin of each pair except one is short and protrudes outwardly from the surface of the disc by a distance equal to the thickness of the thinnest coin to be driven while the other pin is longer.

19. A device as claimed in claim 1 characterized in that a clutch is drivably connected between the motor and disc.

20. A device as claimed in claim 19 characterized in that a switching means is provided to reverse the motor field coils' polarity on the disc stopping the motor.

21. A device as claimed in claim 1 characterized in that the disc is mounted so that in use it is at an angle of substantially 15° to the vertical.

22. A device as claimed in claim 9 characterized in that the radially outer pin of each pair except one is short and protrudes outwardly from the surface of the disc by a distance equal to the thickness of the thinnest coin to be driven while the other pin is longer.

23. A device as claimed in claim 9 characterized in that a clutch is drivably connected between the motor and disc.

24. A device as claimed in claim 23 characterized in that a switching means is provided to reverse the motor field coils' polarity on the disc stopping the motor.

25. A device as claimed in claim 9 characterized in that the disc is mounted so that in use it is at an angle of substantially 15° to the vertical.

* * * * *